US010688627B2

(12) United States Patent
Brawner

(10) Patent No.: US 10,688,627 B2
(45) Date of Patent: Jun. 23, 2020

(54) APPARATUS AND METHODS FOR ALIGNING HEAVY METAL PLATES DURING TANK CONSTRUCTION

(71) Applicant: Bechtel Oil, Gas & Chemicals, Inc., Houston, TX (US)

(72) Inventor: William Brawner, Houston, TX (US)

(73) Assignee: Bechtel Oil, Gas & Chemicals, Inc., Houston, TX (US)

( * ) Notice: Subject to any disclaimer, the term of this patent is extended or adjusted under 35 U.S.C. 154(b) by 0 days.

(21) Appl. No.: 16/305,936

(22) PCT Filed: Jun. 29, 2018

(86) PCT No.: PCT/US2018/040380
§ 371 (c)(1),
(2) Date: Nov. 30, 2018

(87) PCT Pub. No.: WO2018/232423
PCT Pub. Date: Dec. 20, 2018

(65) Prior Publication Data

US 2020/0114493 A1 Apr. 16, 2020

Related U.S. Application Data

(60) Provisional application No. 62/569,747, filed on Oct. 9, 2017, provisional application No. 62/569,754, filed on Oct. 9, 2017, provisional application No. 62/520,779, filed on Jun. 16, 2017.

(51) Int. Cl.
*B25B 11/00* (2006.01)
*B25B 11/02* (2006.01)

(52) U.S. Cl.
CPC ..... *B25B 11/002* (2013.01); *B25B 11/005* (2013.01); *B25B 11/02* (2013.01)

(58) Field of Classification Search
CPC ..... B25B 11/002; B25B 11/005; B25B 11/02
See application file for complete search history.

(56) References Cited

U.S. PATENT DOCUMENTS

| | | | |
|---|---|---|---|
| 3,464,175 | A | 9/1969 | Akita et al. |
| 4,057,170 | A | 11/1977 | Dougherty |
| 2,216,701 | A | 10/1990 | Cole |
| 5,451,275 | A | 9/1995 | Amateau et al. |
| 6,126,892 | A | 10/2000 | Amateau et al. |

(Continued)

OTHER PUBLICATIONS

Lee W. Young, The International Search Report and The Written Opinion of the International Searching Authority, PCT Application No. PCT/US18/40380, dated Sep. 20, 2018, 7 pages, International Searching Authority, Alexandria, Virginia.

(Continued)

*Primary Examiner* — John C Hong
(74) *Attorney, Agent, or Firm* — Crain Caton and James

(57) ABSTRACT

Apparatus and methods for aligning heavy metal plates during tank construction using an alignment device, which is temporarily attached to the heavy metal plates with a pair of locking members pivotably coupled to a frame and a pair of adjustable alignment members attached to the frame between the pair of locking members. The alignment device may be attached to the heavy metal plates without the inefficiencies, hazards and other disadvantages associated with welding.

26 Claims, 6 Drawing Sheets

(56) References Cited

U.S. PATENT DOCUMENTS

| | | | | |
|---|---|---|---|---|
| 9,556,607 | B2 * | 1/2017 | Yamada | E04H 7/18 |
| 2006/0118018 | A1 | 6/2006 | Yang et al. | |
| 2015/0033640 | A1 | 2/2015 | Cantoni | |
| 2015/0233114 | A1 | 8/2015 | Hoefler | |

OTHER PUBLICATIONS

Athina Nickitas-Etienne, International Preliminary Report on Patentability, PCT Application No. PCT/US2018/040380, Dec. 26, 2019, 6 pages, International Bureau, Switzerland.

* cited by examiner

APPARATUS AND METHODS FOR ALIGNING HEAVY METAL PLATES DURING TANK CONSTRUCTION

CROSS-REFERENCE TO RELATED APPLICATIONS

The priority of PCT Patent Application No. PCT/US18/40380, filed on Jun. 29, 2018, which claims the benefit of U.S. Provisional Application No. 62/520,779, filed Jun. 16, 2017, U.S. Provisional Application No. 62/567,747, filed Oct. 9, 2017, and U.S. Provisional Application No. 62/569,754, filed Oct. 9, 2017, is hereby claimed and the specifications thereof are incorporated herein by reference.

FIELD OF THE DISCLOSURE

The following disclosure generally relates to apparatus and methods for aligning heavy metal plates during tank construction. More particularly, the following disclosure relates to aligning heavy metal plates during tank construction using an alignment device that is temporarily attached to the heavy metal plates with a pair of locking members pivotably coupled to a frame and a pair of adjustable alignment members attached to the frame between the pair of locking members.

BACKGROUND

Storage tanks for cryogenic liquids typically include "double" and "full" containment storage tanks for cryogenic liquids. It is not uncommon for such storage tanks to have a form of secondary containment. An outer concrete containment wall can provide secondary containment in the event of a leak in the inner tank. The inner tank is typically made of 11.8 m×3.3 m heavy metal plates comprising stainless steel, aluminum, 9% nickel steel, or other materials suitable for low-temperature or cryogenic service. The inner tank is approximately 33 m tall and has a diameter of approximately 88 m.

The inner tank is typically constructed by positioning a pair of heavy metal plates adjacent one another, using a crane, to form a vertical seam therebetween. A plurality of conventional key plates (FIG. 1) are then welded to one or both of the heavy metal plates adjacent the vertical seam to align the heavy metal plates before the vertical seam is welded. In FIG. 1, each key plate 100 is held in place over the vertical seam 102 by a pair of blank nuts. Each blank nut is welded to a respective heavy metal plate 104, 106 adjacent the vertical seam 102. The key plate 100 is placed over the pair of blank nuts and is secured in place by a pair of bull pins 108, 110. Each bull pin 108, 110 is inserted through a respective opening in the key plate 100 and a respective opening in a respective blank nut. Additional bull pins may then be inserted through the key plate 100 to contact and force one of the heavy metal plates 104, 106 into alignment with the other one of the heavy metal plates 104, 106. At least four (4) and up to ten (10) bull pins may be required to align the heavy metal plates. These bull pins may be used in combination to push the vertical seam 102 out, pull the vertical seam 102 in, open the vertical seam 102 and close the vertical seam 102. Once the heavy metal plates 104, 106 are aligned, a plurality of finger bars 112 are welded to the heavy metal plates 104, 106 over the vertical seam 102 to maintain alignment while the vertical seam 102 is tacked. Because the key plate 100 and finger bar 112 must be welded to the heavy metal plates 104, 106 and forcibly removed by breaking the weld, welding equipment, fire protection, hammers and grinding/polishing equipment are required on site. This process takes time and is subject to numerous work hazards related to welding, hammering bull pins, falling bull pins, stray objects, projectiles, metal splinters and pinch points created by the bull pins and key plate 100. In addition, the key plate 100 cannot adjust to multiple radii because it is flat.

Once enough heavy metal plates have been welded together to form a bottom ring of the inner tank, then next ring is constructed by positioning a plurality of shims (FIG. 3) on a top edge of the bottom ring that will separate the next ring. The next ring is typically constructed in the same manner as the bottom ring by positioning a pair of heavy metal plates adjacent one another on top of the plurality of shims to form a vertical seam therebetween and a horizontal seam between the bottom ring and the pair of heavy metal plates in the next ring. In FIG. 3, each shim 300 must be manually held in place on the top edge 302 of the bottom ring 304 with a pin 301 on one side of a heavy metal plate 306 in the bottom ring 304 while another heavy metal plate 308 is lowered on top of the shim 300 to form a horizontal seam between the heavy metal plate 306 and the another heavy metal plate 308 in the next ring. Once the heavy metal plates 306, 308 are in place, a wedge 312 is inserted through an opening in the shim 300 on another side of the heavy metal plates 306, 308 and is hammered down until the shim 300 is secure. A plurality of conventional key plates (FIG. 1) are then used to align the heavy metal plates in the next ring in the same manner described hereinabove. This process continues until each vertical seam in the next ring is welded. The heavy metal plates in the bottom ring 304 are then aligned with the heavy metal plates in the next ring using a plurality of conventional U-Bars (FIG. 2).

In FIG. 2, each U-Bar 200 is welded in place above the horizontal seam 202. A bull pin 204 is inserted through the U-Bar 200 to align the heavy metal plates 306, 308. As the heavy metal plates in the bottom ring 304 are aligned with the heavy metal plates in the next ring, the horizontal seam 202 is welded and each shim 300 is removed by hammering the wedge 312 up to remove it and hammering the shim 300 out. Besides the inefficiencies and hazards associated with using U-Bars, removing each shim is also subject to numerous work hazards related to hammering wedges in and out, falling wedges, stray objects, projectiles, and pinch points created between the shim and the heavy metal plates. Each ring of the inner tank is constructed in the same manner thus described, which is time consuming, hazardous and requires different types of equipment and skilled labor to complete.

BRIEF DESCRIPTION OF THE DRAWINGS

The detailed description is described with reference to the accompanying drawings, in which like elements are referenced with like reference numbers, and in which.

DETAILED DESCRIPTION OF THE ILLUSTRATIVE EMBODIMENTS

The subject matter disclosed herein is described with specificity, however, the description itself is not intended to limit the scope of the disclosure. The subject matter thus, might also be embodied in other ways, to include different structures, steps and/or combinations similar to and/or fewer than those described herein, in conjunction with other present or future technologies. Although the term "step" may be used herein to describe different elements of methods employed, the term should not be interpreted as implying any particular order among or between various steps herein disclosed unless otherwise expressly limited by the description to a particular order. Other features and advantages of the disclosed embodiments will thus, be or become apparent to one of ordinary skill in the art upon examination of the following figures and detailed description. It is intended that all such features and advantages be included within the scope of the disclosed embodiments. Further, the illustrated figures are only exemplary and are not intended to assert or imply any limitation with regard to the environment, architecture, design, or process in which different embodiments may be implemented. The embodiments disclosed herein thus, may be used to construct different types of tanks other than for storing cryogenic liquids.

The apparatus and methods disclosed herein overcome one or more of the prior art disadvantages of aligning heavy metal plates during tank construction by using an alignment device, which is temporarily attached to the heavy metal plates with a pair of locking members pivotably coupled to a frame and a pair of adjustable alignment members attached to the frame between the pair of locking members. Consequently, the alignment device may be attached to the heavy metal plates without the inefficiencies, hazards and other disadvantages associated with welding.

In one embodiment, an apparatus for aligning heavy metal plates during tank construction is disclosed, comprising: i) an elongated frame; ii) a pair of locking members pivotably coupled to the frame; and iii) a pair of adjustable alignment members attached to the frame between the pair of locking members.

In another embodiment, a method for aligning heavy metal plates during tank construction is disclosed, comprising: i) positioning a pair of heavy metal plates adjacent one another to form a seam therebetween; ii) attaching an alignment device to the pair of heavy metal plates using one of a plurality of magnets attached to the alignment device and a plurality of vacuum pads attached to the alignment device, each one of the plurality of magnets and each one of the plurality of vacuum pads having an activated setting and a deactivated setting; and iii) aligning the pair of heavy metal plates using at least one of a plurality of adjustable alignment members attached to the alignment device.

Figure 1:
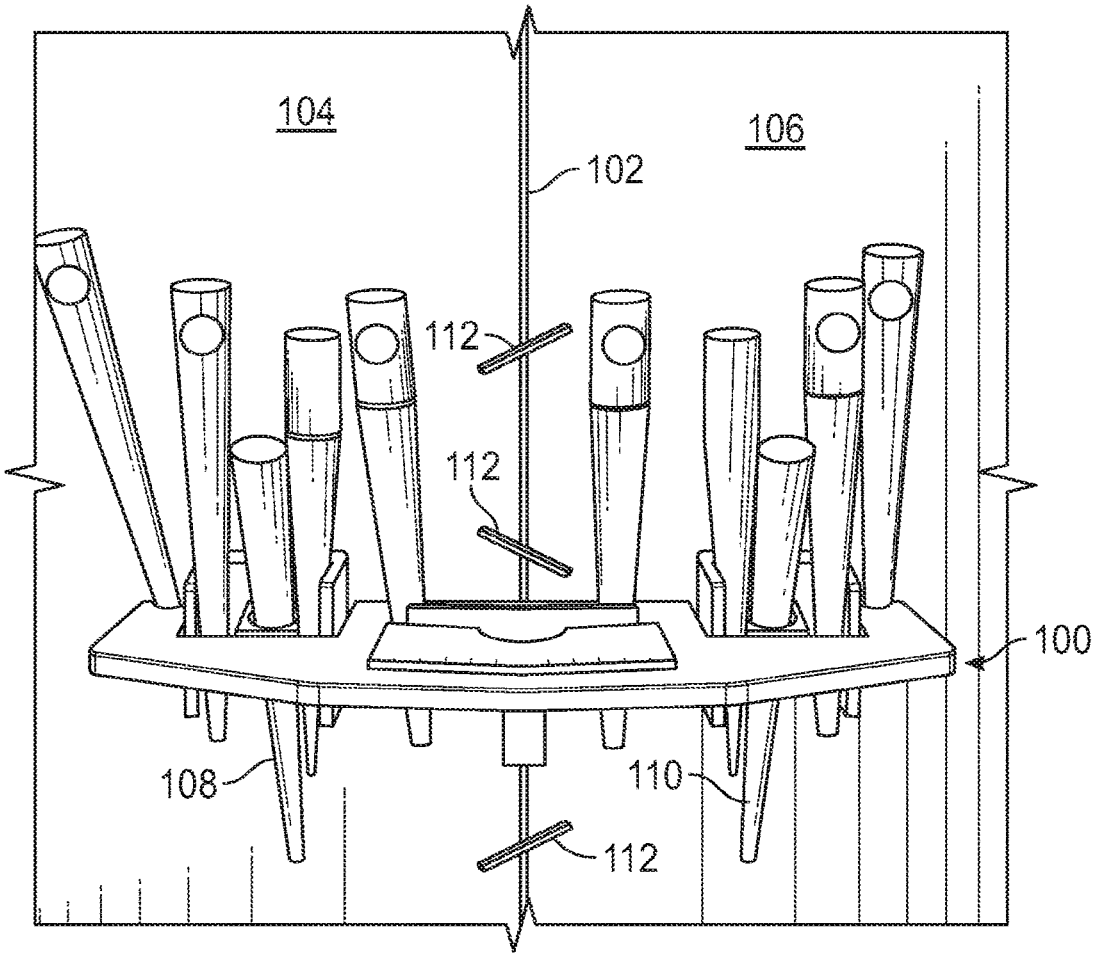
FIG. 1 (Prior Art)
FIG. 1 is a front view of a conventional key plate and finger bars welded to a pair of heavy metal plates for aligning the heavy metal plates along a vertical seam during construction of an inner storage tank.
Figure 2:
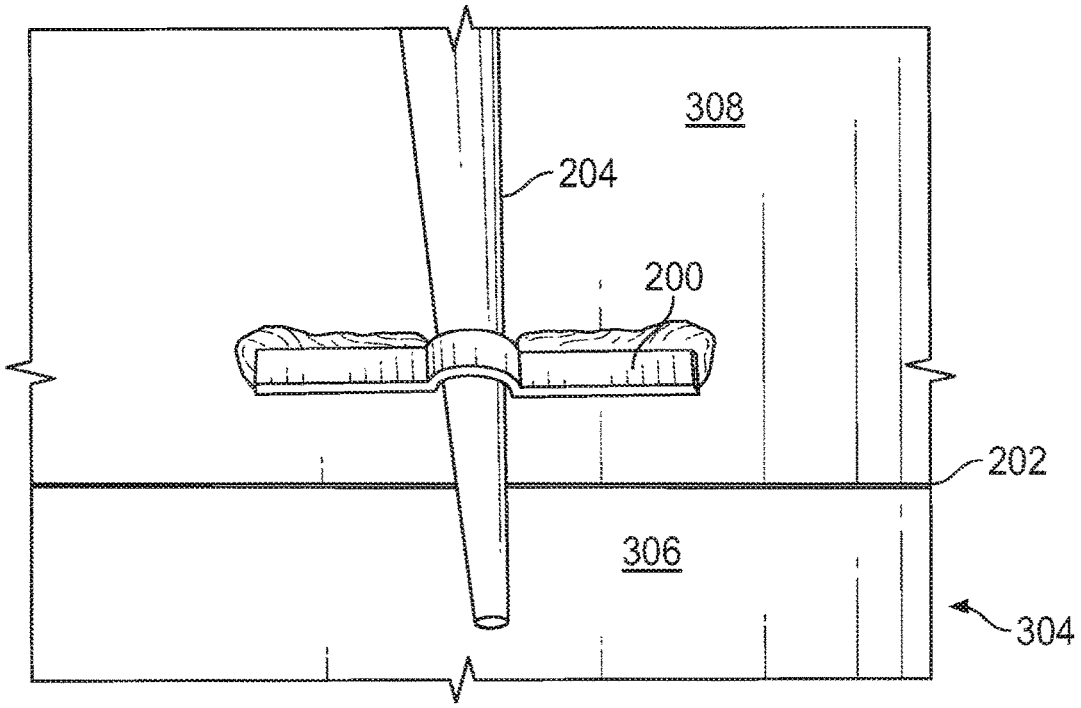
FIG. 2 (Prior Art)
FIG. 2 is a front view of a conventional U-Bar welded to a heavy metal plate for aligning a pair of heavy metal plates along a horizontal seam during construction of an inner storage tank.
Figure 3:
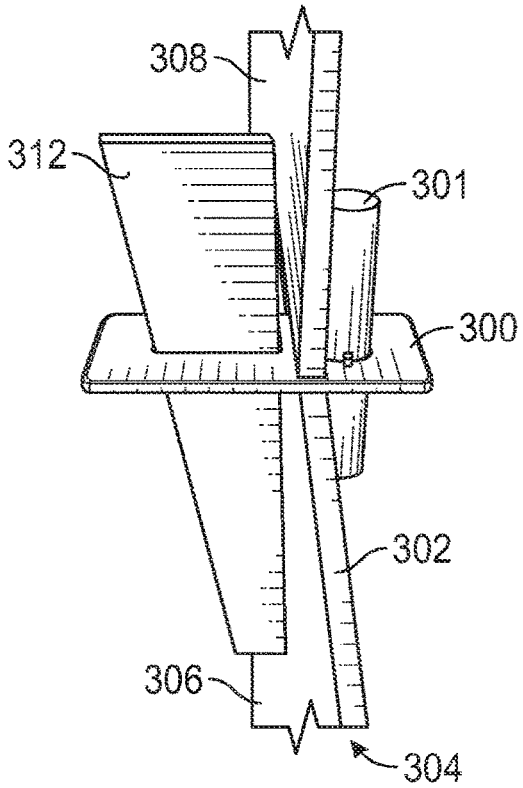
FIG. 3 (Prior Art)
FIG. 3 is a side view of a conventional shim secured between a pair of heavy metal plates for separating the pair of heavy metal plates along a horizontal seam during construction of an inner storage tank.
Figure 4A:
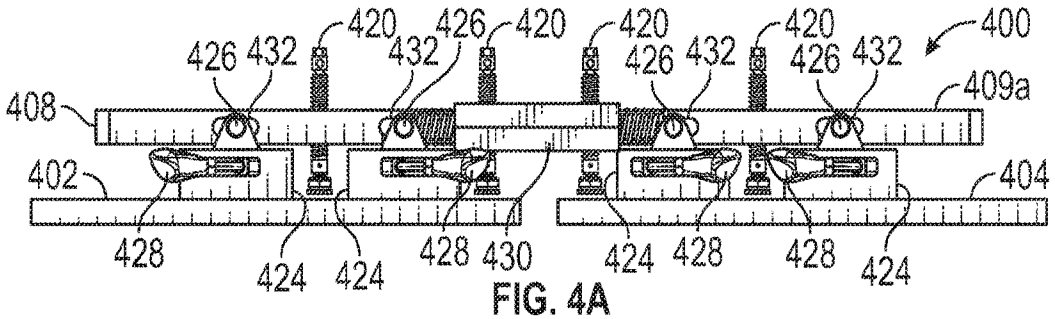
FIGS. 4A and 4B illustrate a side view and a front view, respectively, of an alignment device disclosed herein for aligning a pair of heavy metal plates along a vertical seam during construction of an inner storage tank.
Figure 4B:
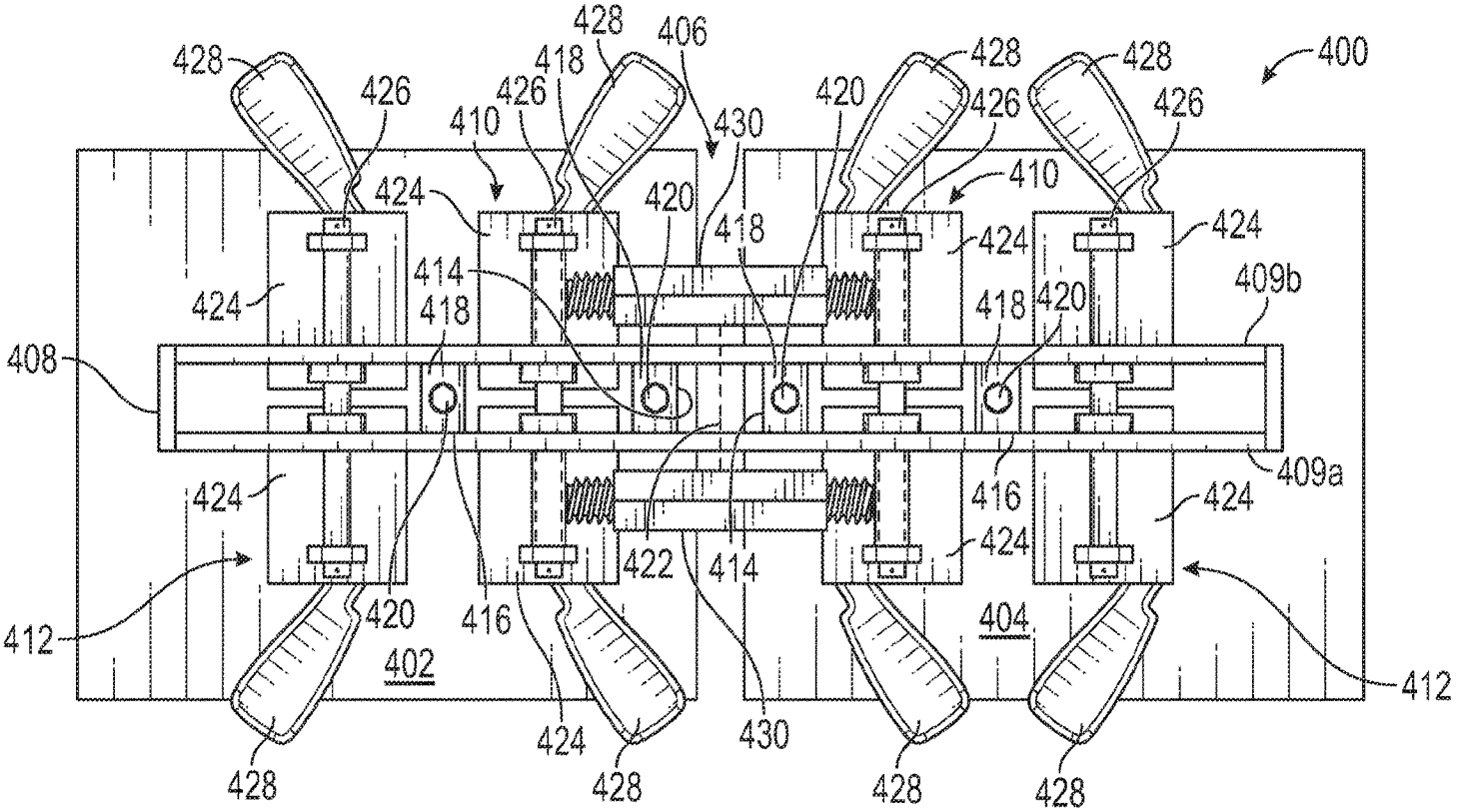

Referring now to FIGS. 4A and 4B, a side view and a front view, respectively, illustrate an alignment device 400 for aligning a pair of heavy metal plates 402, 404 along a vertical seam 406 during construction of an inner storage tank. The alignment device 400 includes an elongated frame 408, a pair of locking members 410 pivotably coupled to the frame 408 and another pair of locking members 412 pivotably coupled to the frame 408. The alignment device 400 further includes a pair of adjustable alignment members 414 attached to the frame 408 between the pair of locking members 410 and another pair of adjustable alignment members 416 attached to the frame 408 between a respective one of the pair of locking members 410 and a respective one of the another pair of locking members 412. The frame 408 includes two substantially parallel metal plates 409*a*, 409*b* separated by the pair of adjustable alignment members 414 and the another pair of adjustable alignment members 416 attached thereto. Each adjustable alignment member includes a housing 418 with a threaded passage therethrough and a respective threaded rod 420 threadably engaged with the housing 418 through the threaded passage. Each threaded rod 420 is substantially perpendicular to the frame 408. The pair of adjustable alignment members 414 and the another pair of adjustable alignment members 416 are equidistantly positioned from a center of the frame 422 for balance. The pair of adjustable alignment members 414 are thus, positioned opposite one another relative to the center of the frame 422. Likewise, the another pair of adjustable alignment members 416 are positioned opposite one another relative to the center of the frame 422.

Each locking member includes a pair of housings 424 pivotably coupled to the two substantially parallel metal plates 409*a*, 409*b* by a pin 426 and a respective pair of locking devices. Preferably, each locking device is a magnet with an activated setting and a deactivated setting that may be controlled with a handle 428. The magnet may be a rare earth magnet (such as neodymium, samarium cobalt, alnico or another rare earth magnet), an electro magnet or any combination thereof. Alternatively, each locking device may be a vacuum pad or any other equivalent means for securing the alignment device 400 to the pair of heavy metal plates 402, 404 that includes an activated setting and a deactivated setting. The pair of locking members 410 and the another pair of locking members 412 are equidistantly positioned from a center of the frame 422 for balance. The pair of pair of locking members 410 are thus, positioned opposite one another relative to the center of the frame 422. Likewise, the another pair of locking members 412 are positioned opposite one another relative to the center of the frame 422. In order to adjust (open and close) the vertical seam 406 when the alignment device 400 is secured to the pair of heavy metal plates 402, 404, the pair of locking members 410 are adjustably coupled together by a pair of guide rails 430 for simultaneously moving the pair of locking members 410 toward the pair of adjustable alignment members 414 and for simultaneously moving the pair of locking members 410 away from the pair of adjustable alignment members 414. The pair of locking members 410 and the another pair of locking members 412 are therefore, slideably coupled to the frame 408 by securing each pin 426 within a respective slot 432 through each of the two substantially parallel metal plates 409*a*, 409*b*. Each guide rail 430 preferably includes a pair of threaded rods joined by a coupling nut, however, may include any other equivalent means (e.g. cam lock, air cylinder, hydraulic cylinder, etc.) for moving the pair of locking members 410 toward the pair of adjustable alignment members 414 and for simultaneously moving the pair of locking members 410 away from the pair of adjustable alignment members 414. Each guide rail 430 may be attached at each end to a respective pin 426 outside the two substantially parallel metal plates 409*a*, 409*b*.

Once the pair of heavy metal plates 402, 404 are positioned adjacent one another to form a vertical seam 406 therebetween, the alignment device 400 may be attached thereto for aligning the pair of heavy metal plates 402, 404 along the vertical seam 406 and adjusting the vertical seam 406 (open and close) during construction of an inner storage tank. The alignment device 400 is positioned substantially perpendicular to the vertical seam 406 so that the pair of adjustable alignment members 414 are positioned over a respective heavy metal plate 402, 404. The pair of locking members 410 are then secured to a respective heavy metal plate 402, 404 by activating each locking device (e.g. magnet) for a respective pair of the locking members 410 with the handle 428. One or both of the pair of adjustable alignment members 414 may then be used to align the pair of heavy metal plates 402, 404 along the vertical seam 406. The pair of heavy metal plates 402, 404 may be aligned along the vertical seam 406 by threadably adjusting a threaded rod 420 for one of the pair of adjustable alignment members 414 to contact and force one of the pair of heavy metal plates 402, 404 into alignment with another one of the pair of heavy metal plates 402, 404. Preferably, the another pair of locking members 412 are also secured to a respective heavy metal plate 402, 404 by activating each locking device (e.g. magnet) for a respective another pair of locking members 412 with the handle 428. This adds additional support and stability when using the alignment device 400 and may be necessary when adjusting the vertical seam 406. Optionally, the pair of heavy metal plates 402, 404 may be aligned along the vertical seam 406 by threadably adjusting a threaded rod 420 for one or both of the another pair of adjustable alignment members 416 to contact and force one or both of the pair of heavy metal plates 402, 404 to rise into alignment with another one of the pair of heavy metal plates 402, 404 under one or both of the pair of adjustable alignment members 414. In this operation, the threaded rod 420 for the pair of adjustable alignment members 414 must not interfere with (i.e. contact) movement of the pair of heavy metal plates 402, 404 and the another pair of locking members 412 must not be secured to a respective heavy metal plate 402, 404. The vertical seam 406 may be closed by using guide rails 430 to simultaneously move the pair of locking members 410 toward the pair of adjustable alignment members 414. The vertical seam 406 may be opened by using guide rails 430 to simultaneously move the pair of locking members 410 away from the pair of adjustable alignment members 414. Each slot 432 permits lateral movement of the pair of locking members 410 and the another pair of locking members 412 relative to the frame 408 when adjusting the vertical seam 406 and each pin 426 permits pivotal movement of the pair of locking members 410 and the another pair of locking members 412 relative to the frame 408 when it is attached to the pair of heavy metal plates 402, 404. The alignment device 400 is therefore, capable of attachment to heavy metal plates with multiple radii. More importantly, the alignment device 400 may be attached to heavy metal plates, removed and reused without the inefficiencies, hazards, waste and other disadvantages associated with welding conventional keyplates and finger bars to the heavy metal plates.

Figure 5A:
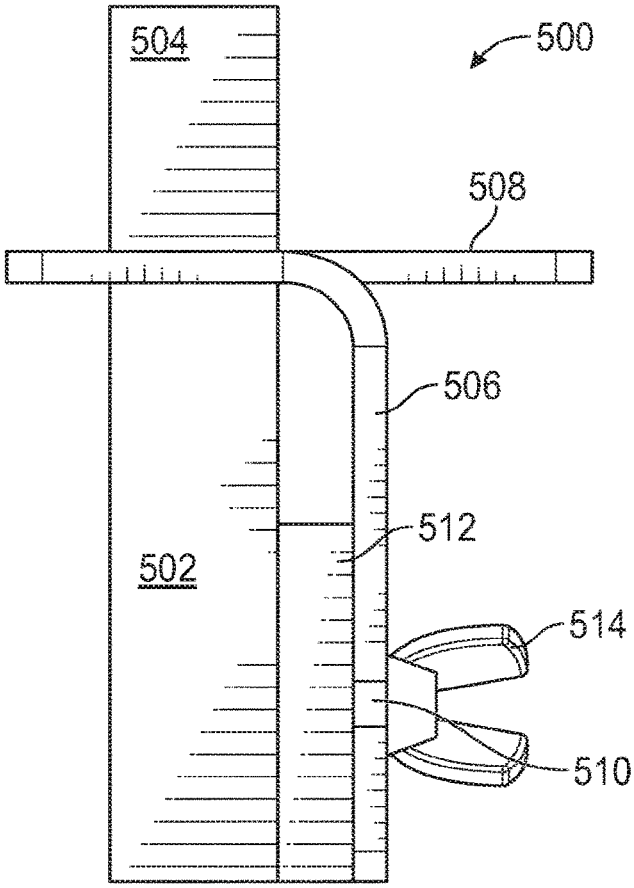
FIGS. 5A and 5B illustrate a side view and a front view, respectively, of a shim disclosed herein for separating a pair of heavy metal plates along a horizontal seam during construction of an inner storage tank.
Figure 5B:
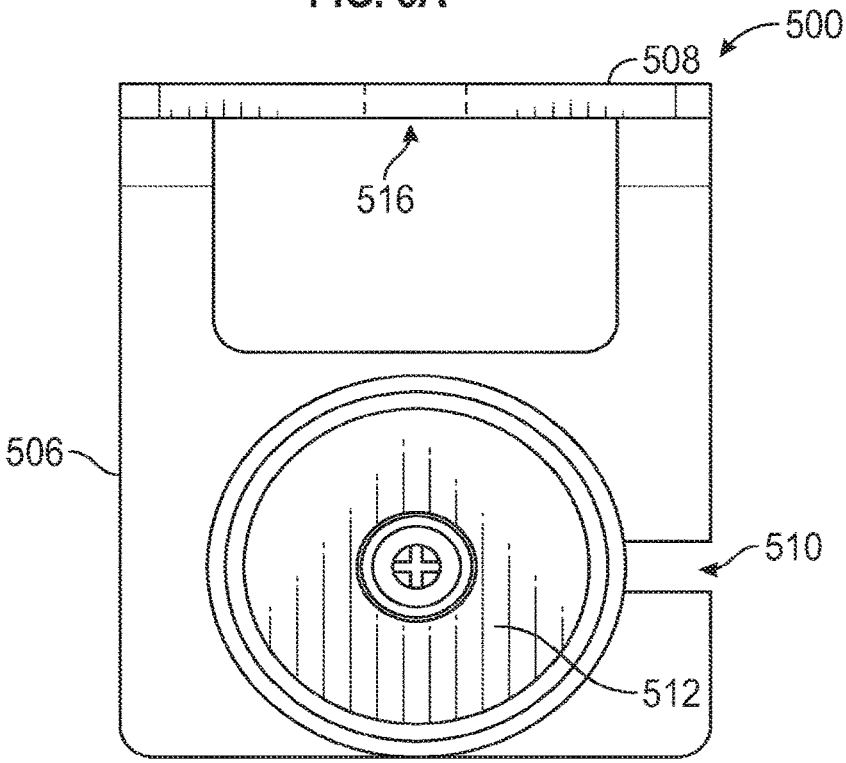

Referring now to FIGS. 5A and 5B, a side view and a front view, respectively, illustrate a shim 500 for separating a pair of heavy metal plates 502, 504 along a horizontal seam during construction of an inner storage tank. The shim 500 includes a side section 506 and a top section 508. The side section 506 is substantially perpendicular to the top section 508 and includes a slot 510 with an open end for receipt of a magnet 512. The magnet 512 may be temporarily secured within the slot 510 by tightening a wing nut 514 to a threaded rod attached to the back of the magnet 512 until the wing nut 514 is tightly secured against a back of the side section 506. The top section 508 extends away from the back and a front of the side section 506 and includes a slot 516 that also extends away from the back and the front of the side section 506. Once the magnet 512 is temporarily secured within the slot 510 to the front of the side section 506, the portion of the top section 508 extending away from the front of the side section 506 is positioned over a top edge of one of the pair of heavy metal plates 502 and the magnet 512 is attached to the same heavy metal plate 502. The other one of the pair of heavy metal plates 504 is then positioned (lowered) on top of the portion of the top section 508 positioned over the top edge of one of the pair of heavy metal plates 502. A plurality of shims 500 may be positioned in this manner to separate the pair of heavy metal plates 502, 504 and form a horizontal seam therebetween. The slot 516 may be used to remove the shim 500 once the pair of heavy metal plates 502, 504 are aligned and welded together.

Figure 6A:
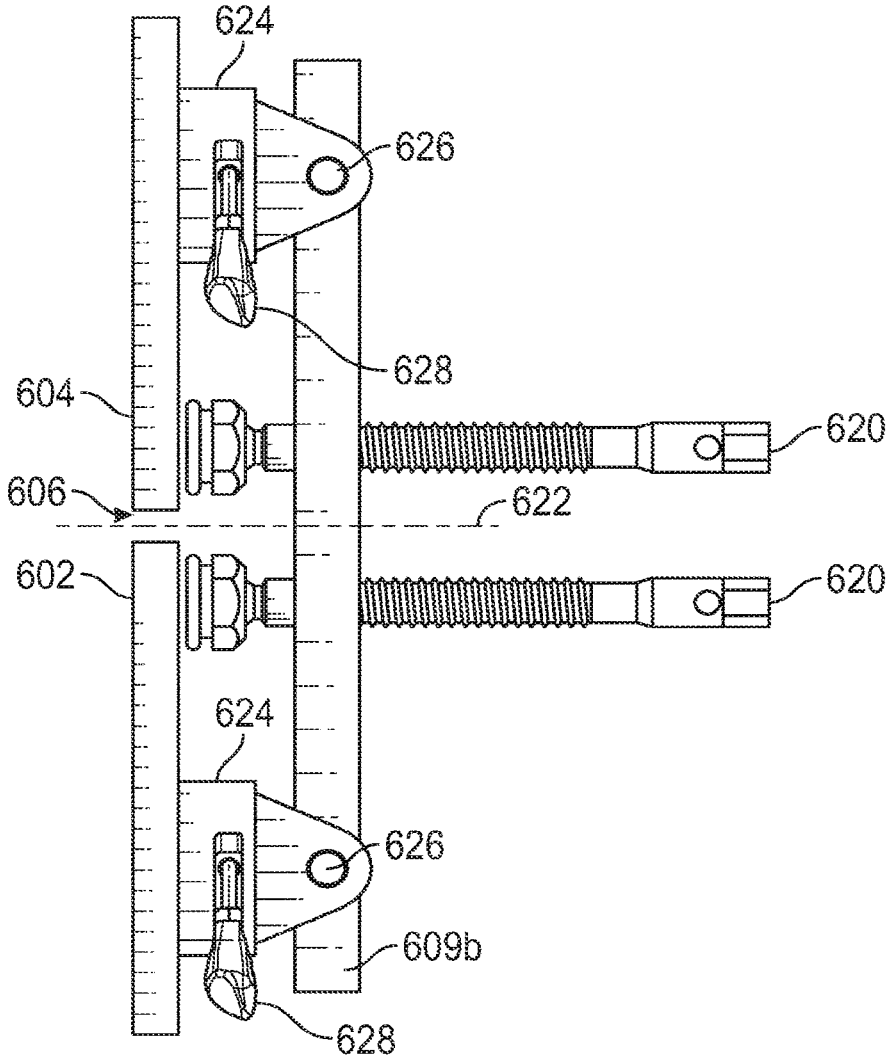
FIGS. 6A and 6B illustrate a side view and a front view, respectively, of another alignment device disclosed herein for aligning a pair of heavy metal plates along a horizontal seam during construction of an inner storage tank.
Figure 6B:
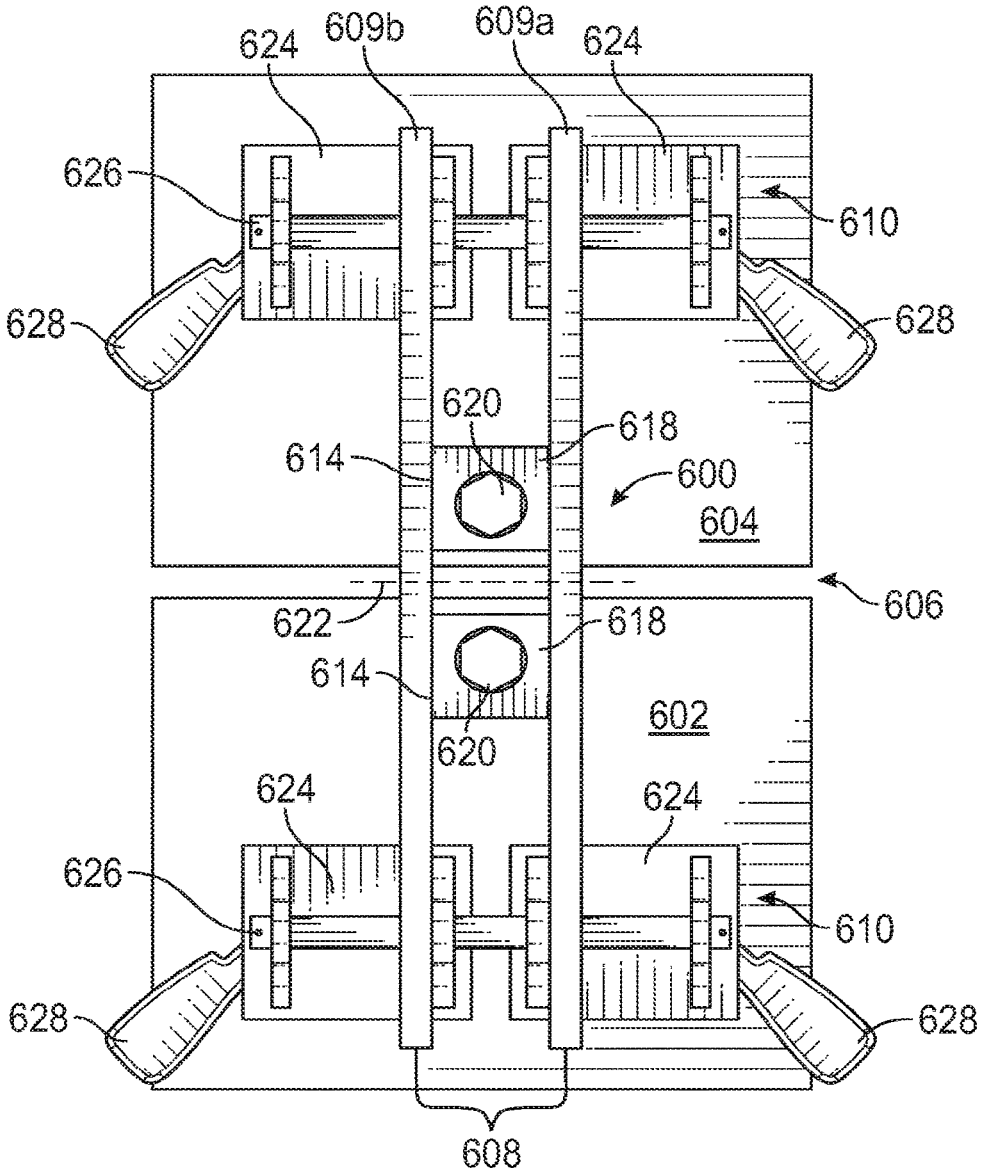

Referring now to FIGS. 6A and 6B, a side view and a front view, respectively, illustrate another alignment device 600 for aligning a pair of heavy metal plates 602, 604 along a horizontal seam 606 during construction of an inner storage tank. The alignment device 600 includes an elongated frame 608, a pair of locking members 610 pivotably coupled to the frame 608 and a pair of adjustable alignment members 614 attached to the frame 608 between the pair of locking members 610. The frame 608 includes two substantially parallel metal plates 609*a*, 609*b* separated by the pair of adjustable alignment members 614 attached thereto. Each adjustable alignment member includes a housing 618 with a threaded passage therethrough and a respective threaded rod 620 threadably engaged with the housing 618 through the threaded passage. Each threaded rod 620 is substantially perpendicular to the frame 608. The pair of adjustable alignment members 614 are equidistantly positioned from a center of the frame 622 for balance. The pair of adjustable alignment members 614 are thus, positioned opposite one another relative to the center of the frame 622.

Each locking member includes a pair of housings 624 pivotably coupled to the two substantially parallel metal plates 609*a*, 609*b* by a pin 626 and a respective pair of locking devices. Preferably, each locking device is a magnet with an activated setting and a deactivated setting that may be controlled with a handle 628. Alternatively, each locking device may be a vacuum pad or any other equivalent means for securing the alignment device 600 to the pair of heavy metal plates 602, 604 that includes an activated setting and a deactivated setting. The pair of locking members 610 are equidistantly positioned from a center of the frame 622 for balance. The pair of pair of locking members 610 are thus, positioned opposite one another relative to the center of the frame 622.

Once the pair of heavy metal plates 602, 604 are separated and positioned adjacent one another to form a horizontal seam 606 therebetween (e.g. using a shim 500 in the manner described in reference to FIGS. 5A-5B), the alignment device 600 may be attached thereto for aligning the pair of heavy metal plates 602, 604 along the horizontal seam 606 during construction of an inner storage tank. The alignment device 600 is positioned substantially perpendicular to the horizontal seam 606 so that the pair of adjustable alignment members 614 are positioned over a respective heavy metal plate 602, 604. Alternatively, the alignment device 600 may be positioned so that the pair of adjustable alignment members 614 are each positioned over a single heavy metal plate 602, 604. The pair of locking members 610 are then secured to a respective heavy metal plate 602, 604 by activating each locking device (e.g. magnet) for a respective pair of the locking members 610 with the handle 628. One or both of the pair of adjustable alignment members 614 may then be used to align the pair of heavy metal plates 602, 604 along the horizontal seam 606. The pair of heavy metal plates 602, 604 may be aligned along the horizontal seam 606 by threadably adjusting a threaded rod 620 for one or both of the pair of adjustable alignment members 614 to contact and force one of the pair of heavy metal plates 602, 604 into alignment with another one of the pair of heavy metal plates 602, 604. Each pin 626 permits pivotal movement of the pair of locking members 610 relative to the frame 608 when it is attached to the pair of heavy metal plates 602, 604. The alignment device 600 is therefore, capable of attachment to heavy metal plates with multiple radii. More importantly, the alignment device 600 may be attached to heavy metal plates, removed and reused without the inefficiencies, hazards, waste and other disadvantages associated with welding conventional U-bars to the heavy metal plates.

Due to the different forces acting on the heavy metal plates during alignment along a vertical seam and a horizontal seam, different embodiments of the alignment device may be used as described herein with reference to FIGS. 4A,4B and FIGS. 6A,6B. Nevertheless, the same embodiment may be used to align heavy metal plates along a vertical seam and a horizontal seam, depending on the weight of the heavy metal plates, and the functional advantages over welding conventional devices to the heavy metal plates remains the same for the embodiments described herein. In addition, each locking member for each embodiment may only include a single housing/locking device depending on the weight of the heavy metal plates.

While the present disclosure has been described in connection with presently preferred embodiments, it will be understood by those skilled in the art that it is not intended to limit the disclosure to those embodiments. It is therefore, contemplated that various alternative embodiments and modifications may be made to the disclosed embodiments without departing from the spirit and scope of the disclosure defined by the appended claims and equivalents thereof.

The invention claimed is:

1. An apparatus for aligning heavy metal plates during tank construction, comprising:

an elongated frame;

a pair of locking members pivotably coupled to the frame; and a pair of adjustable alignment members attached to the frame between the pair of locking members.

2. The apparatus of claim 1, further comprising:

another pair of locking members pivotably coupled to the frame;

another pair of adjustable alignment members attached to the frame between a respective one of the pair of locking members and a respective one of the another pair of locking members;

wherein the pair of locking members and the another pair of locking members are slideably coupled to the frame; and wherein the pair of locking members are adjustably coupled together by a pair of guide rails for simultaneously moving the pair of locking members toward the pair of adjustable alignment members and for simultaneously moving the pair of locking members away from the pair of adjustable alignment members attached thereto.

3. The apparatus of claim 2, wherein the frame includes two parallel metal plates separated by the pair of adjustable alignment members and the another pair of adjustable alignment members attached thereto.

4. The apparatus of claim 3, wherein each adjustable alignment member includes a housing with a threaded passage therethrough and a respective threaded rod threadably engaged with the housing through the threaded passage.

5. The apparatus of claim 4, wherein each threaded rod is perpendicular to the frame.

6. The apparatus of claim 2, wherein the pair of adjustable alignment members and the another pair of adjustable alignment members are equidistantly positioned from a center of the frame, the pair of adjustable alignment members are positioned opposite one another relative to the center of the frame, and the another pair of adjustable alignment members are positioned opposite one another relative to the center of the frame.

7. The apparatus of claim 2, wherein the pair of locking members and the another pair of locking members are equidistantly positioned from a center of the frame, the pair of pair of locking members are positioned opposite one another relative to the center of the frame, and the another pair of locking members are positioned opposite one another relative to the center of the frame.

8. The apparatus of claim 3, wherein each locking member includes a pair of housings pivotably coupled to the two parallel metal plates by a pin and a respective pair of locking devices.

9. The apparatus of claim 8, wherein each locking device is a magnet with an activated setting and a deactivated setting.

10. The apparatus of claim 8, wherein each locking device is a vacuum pad with an activated setting and a deactivated setting.

11. The apparatus of claim 8, wherein each pin for each locking member is slideably secured within a respective slot through the two parallel metal plates.

12. The apparatus of claim 8, wherein each guide rail includes a pair of threaded rods joined by a coupling nut.

13. The apparatus of claim 1, wherein the frame includes two parallel metal plates separated by the pair of adjustable alignment members.

14. The apparatus of claim 13, wherein each adjustable alignment member includes a housing with a threaded passage therethrough and a respective threaded rod threadably engaged with the housing through the threaded passage.

15. The apparatus of claim 14, wherein each threaded rod is perpendicular to the frame.

16. The apparatus of claim 13, wherein each locking member includes a pair of housings pivotably coupled to the two parallel metal plates by a pin and a respective pair of locking devices.

17. The apparatus of claim 16, wherein each locking device is a magnet with an activated setting and a deactivated setting.

18. The apparatus of claim 16, wherein each locking device is a vacuum pad with an activated setting and a deactivated setting.

19. The apparatus of claim 1, wherein the adjustable alignment members are equidistantly positioned from a center of the frame and are positioned opposite one another relative to the center of the frame.

20. The apparatus of claim 1, wherein the locking members are equidistantly positioned from a center of the frame and are positioned opposite one another relative to the center of the frame.

21. A method for aligning heavy metal plates during tank construction, comprising:

positioning a pair of heavy metal plates adjacent one another to form a seam therebetween;

attaching an alignment device to the pair of heavy metal plates using one of a plurality of magnets attached to the alignment device and a plurality of vacuum pads attached to the alignment device, each one of the plurality of magnets and each one of the plurality of vacuum pads having an activated setting and a deactivated setting; and aligning the pair of heavy metal plates using at least one of a plurality of adjustable alignment members attached to the alignment device.

22. The method of claim 21, further comprising:

attaching a plurality of shims with magnets along a top edge of one of the pair of heavy metal plates;

positioning another one of the pair of heavy metal plates on top of the plurality of shims to form a horizontal seam between the one of the heavy metal plates and the another one of the heavy metal plates;

attaching one of the one of the plurality of magnets and the plurality of vacuum pads to one of the pair of heavy metal plates and another one of the one of the plurality of magnets and the plurality of vacuum pads to another one of the pair of heavy metal plates; and aligning the pair of heavy metal plates by adjusting the at least one of the plurality of adjustable alignment members to contact and force one of the pair of heavy metal plates into alignment with another one of the pair of heavy metal plates.

23. The method of claim 21, further comprising:

positioning the pair of heavy metal plates adjacent one another to form a vertical seam therebetween;

attaching a pair of the one of the plurality of magnets and the plurality of vacuum pads to one of the pair of heavy metal plates and another pair of the one of the plurality of magnets and the plurality of vacuum pads to another one of the pair of heavy metal plates; and aligning the pair of heavy metal plates by adjusting the at least one of the plurality of adjustable alignment members to contact and force one of the pair of heavy metal plates into alignment with another one of the pair of heavy metal plates.

24. The method of claim 23, wherein one of the pair of the one of the plurality of magnets and the plurality of vacuum pads attached to the one of the pair of heavy metal plates is adjustably coupled to a closest one of the another pair of the one of the plurality of magnets and the plurality of vacuum pads attached to the another one of the pair of heavy metal plates.

25. The method of claim 24, further comprising:

adjusting the vertical seam by moving the one of the pair of the one of the plurality of magnets and the plurality of vacuum pads attached to the one of the pair of heavy metal plates away from the one of the another pair of the one of the plurality of magnets and the plurality of vacuum pads attached to the another one of the pair of heavy metal plates.

26. The method of claim 24, further comprising:

adjusting the vertical seam by moving the one of the pair of the one of the plurality of magnets and the plurality of vacuum pads attached to the one of the pair of heavy metal plates toward the one of the another pair of the one of the plurality of magnets and the plurality of vacuum pads attached to the another one of the pair of heavy metal plates.

* * * * *